United States Patent [19]

Knoblauch

[11] Patent Number: 4,625,863

[45] Date of Patent: Dec. 2, 1986

[54] CONNECTING CLIP

[75] Inventor: Georg Knoblauch, Giengen, Fed. Rep. of Germany

[73] Assignee: Firma Georg Knoblauch, Giengen, Fed. Rep. of Germany

[21] Appl. No.: 703,932

[22] Filed: Feb. 21, 1985

[30] Foreign Application Priority Data

Feb. 22, 1984 [DE] Fed. Rep. of Germany ..... 3406332

[51] Int. Cl.[4] ..... B65D 85/29

[52] U.S. Cl. ..... 206/379; 312/DIG. 33

[58] Field of Search ..... 24/573, 453, 458; 403/206, 208, 209, 85; 312/275, 276, DIG. 33; 206/379

[56] References Cited

U.S. PATENT DOCUMENTS 2,832,015 4/1958 Ortega ..... 24/458
4,512,467 4/1985 Knoblauch ..... 206/379

FOREIGN PATENT DOCUMENTS 2461766 8/1976 Fed. Rep. of Germany ..... 206/379
8304781 6/1983 Fed. Rep. of Germany .
82445 1/1935 Sweden ..... 403/209

*Primary Examiner*—Francis K. Zugel
*Assistant Examiner*—Joseph Falk
*Attorney, Agent, or Firm*—Karl F. Ross; Herbert Dubno

[57] ABSTRACT

A connecting clip has a clip arm and two clip legs extending from the clip arm. Pivot eyes are formed at the free ends of the clip legs with the pivot eye axes substantially parallel to the clip arm. In order that the combining clip be held with several others in a heap-like arrangement and be mounted automatically, the clip arm is bent with its free end on the same side of both of the clip legs and the clip legs are formed with enlargements lying approximately opposite each other in the plane of the clip legs. These enlargements are formed by a pair of bent portions, preferably opposing indentations directed toward each other. The indentations are conformed for engagement by a gripper with which the combining clip can be automatically mounted.

3 Claims, 6 Drawing Figures

CONNECTING CLIP

FIELD OF THE INVENTION

This invention relates to a connecting clip for a case for storage of objects such as tools or the like, and, more particularly, to a connecting clip which provides a coupling between the case cover and a holder insert for slender work tools such as spiral drills, taps or the like, so that the holder insert can be automatically raised, when the cover of the case is raised. The invention is especially applicable to a drill index as shown and described in the copending application Ser. No. 847,098 filed Apr. 2, 1986.

BACKGROUND OF THE INVENTION

Typical prior art connecting clips for tool cases and the like comprise a clip arm and two clip legs extending from it, the clip legs having at each free end a privot eye whose pivot eye axis is substantially parallel to the clip arm, wherein the connecting clip is pivotally attached at one of its sides to a clip pivot on the inner side of the tool case cover and at its other opposite side by the pivot eyes to pivot pins attached to a swingable holder insert for work tools and the like.

These connecting clips are used as a means of attaching the cover of a tool case, comprising a case bottom having at least one tool holder insert which is pivotable upwards from the case, to a swingable insert so that, when the cover of the tool case is raised, the swingable holder insert having spiral drills, taps or like work tools, is automatically swung up so that the tools are accessible.

Connecting clips of this kind are generally formed U- or V-shaped by bending wire, that is, each clip leg is bent away from the clip arm, and the pivot eyes are formed by bending the clip legs at their free ends into a loop. Cases with such a connecting clip are described in German patent DE-PS 24 61 766.

Further the clip pivot on the inside of the case cover is formed from a pivot bar arched toward the case interior, which is positioned with both of its ends on the case cover. For mounting the connecting clip both its clip legs must therefore be passed completely through the clip pivot, before subsequently the clip arm can be inserted in the clip pivot by simultaneously turning or twisting the clip legs of the connecting clip.

The pivot pins engaged in the pivot eyes are shaft-like pieces of sheet metal of the holder insert, which stand coaxial with and opposing each other and with their free ends turned either toward each other or from each other.

In this arrangement of the pivot pins for mounting of the connecting clip by pressing both the elastic clip legs together or expanding them, the pivot eyes will be brought into a coaxial position with the pivot pins so that the pivot eyes can be pushed axially on the pivot pins, when the connecting clip springs back into its initial position.

For mounting the prior art connecting clip poses problems with respect to separation from a collection of clips and in the inability to automate its serial mounting in assembly of drill indexes or cases.

This earlier connecting clip precludes automatic control of its mounting in the case. The mounting of the prior art connecting clip is possible only in a personal and time consuming manual fashion.

OBJECTS OF THE INVENTION

It is the general object of my invention to provide a connecting clip for a tool case or the like as described above shaped so that it can be easily handled after being produced and readily mounted on a case by a clip supply system automatically receiving and subsequently automatically introducing the connecting clip to the case.

It is another object of the invention to provide an improved connecting clip for a tool case whereby the disadvantages of earlier clips are obviated.

It is a further object of this invention to provide a connecting clip for a tool case or the like of the foregoing kind shaped so that it can be automatically mounted in the tool case after its manufacture.

It is also an object of this invention to provide a connecting clip for a drill index which, after its manufacture, can be supplied to a supply apparatus which mounts the clip automatically.

SUMMARY OF THE INVENTION

These objects and others which will become apparent hereinafter are attained in accordance with the invention in a connecting clip for a tool case (preferably a drill index) having a clip arm and two clip legs extending from the clip arm, a pivot eye attached to the end of each of the clip legs with the pivot eye axis substantially parallel to the clip arm, the connecting clip being used in a case for storage of objects, particularly slender work tools such as spiral drills, taps or the like, the case comprising a case bottom having at least one pivotable holder insert therein for receiving and holding the objects and a case cover connected to the holder insert by the connecting clip, by-means-of which the holder insert is swung up automatically, when the case is opened by raising the cover, wherein the combining clip is inserted in a clip pivot on the inner side of the case cover and is compressed or expanded so that the pivot eyes of the clip legs engage on and are held by the pivot pins of the holder insert.

According to the invention the clip arm is extended with its free end bent away from the legs on the same side of both clip legs. Furthermore each of the clip legs has an enlargement lying in the plane of the clip legs, these enlargements being formed by a pair of bent portions, each of these bent portions lying opposing each other on opposing clip legs.

Preferably the bent portions are constructed as indentations in the clip legs and the indentations of each clip leg are preferably directed toward each other.

In a particularly preferred embodiment, the clip legs extending from the clip arm are formed substantially perpendicularly to the clip arm, and a portion of one of the substantially perpendicular clip legs is bent so as to run parallel side-by-side next to the adjacent other one of the clip legs.

In the direction of the pivot eyes from the adjacent parallel running side-by-side portion of the clip legs, one of the clip legs is bent so as to have a portion running parallel to the clip arm, the portion of the clip legs bent parallel to the clip arm further in the direction of the pivot eye being bent back toward the other one of the clip legs.

Furthermore substantially centrally located between the portion of the clip leg running parallel to the clip arm and the pivot eyes I position respective enlargements in the form of bent portions.

The invention achieves its inventive advantages by providing the clip with the aforementioned enlargements, preferably bent portions, on the clip legs so that immediately after its manufacture in a suitable system or from a stored array piled up as well, they can be taken by an automatic gripper system for mounting in the correct position. The gripper system with gripping fingers engages in the bent portions forming the enlargements and thereby not only is able to hold the clip and insert it with the free end of its clip arm into the clip pivot on the inside of the case cover, but also, on account of the particular structure of the indentations of the bent portions, can press together or expand the clip legs for mounting of the combining clip on the pivot pins according to the requirements. As a result the inventive combining clip can be produced in a fully automated process including mounting in position in the case.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
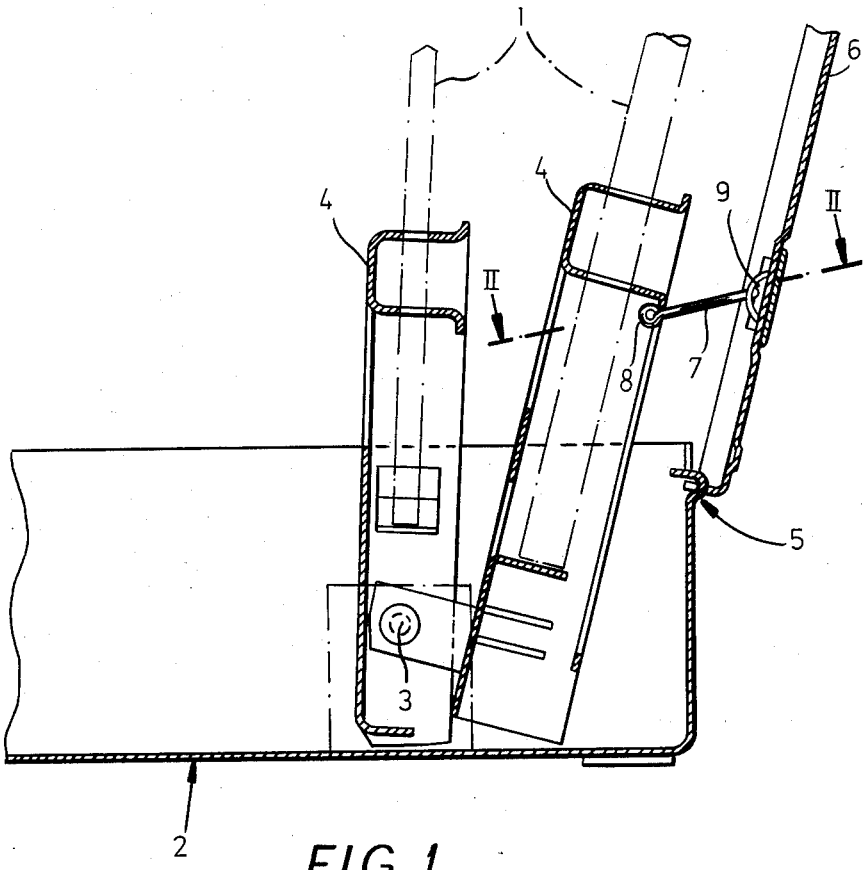
FIG. 1 is a side sectional view of the connecting clip of this invention seen attached in position in the case in which it is provided.
Figure 2:
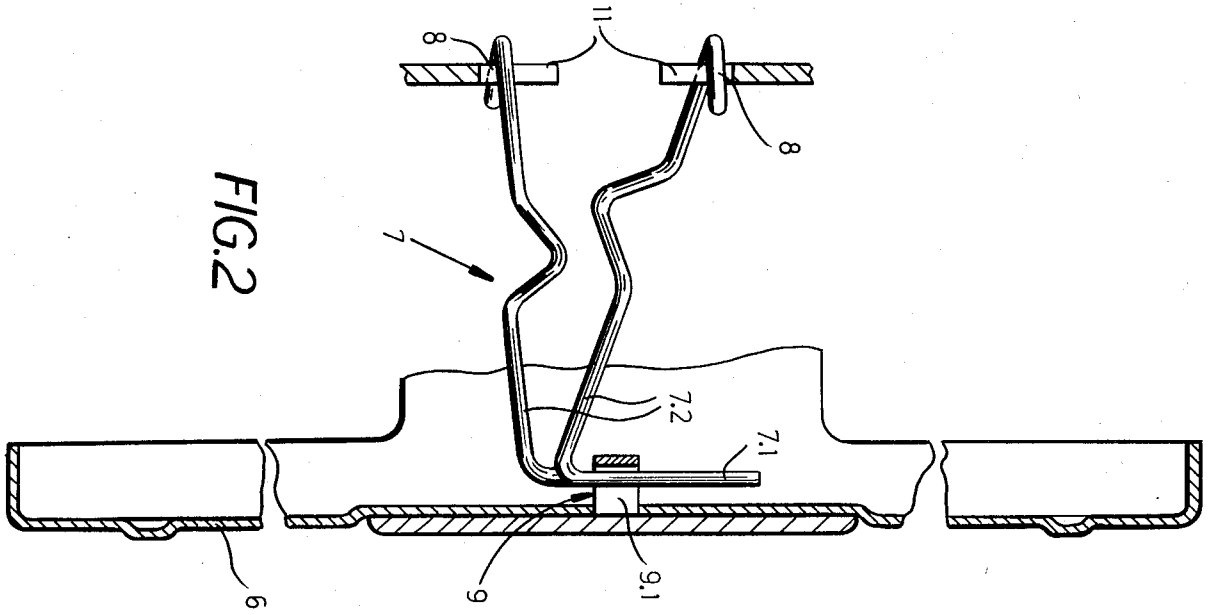
FIG. 2 is a partially sectional view along line II—II of FIG. 1 of the connecting clip 7 according to the embodiment of FIG. 1.

The case seen in FIGS. 1 and 2 is a drill index used for storage of work tools such as drill bits 1, only indicated by dot-dashed lines in FIG. 1.

It comprises a case bottom 2, in which in the preferred embodiment two holder inserts 4 for receiving the work tools 1 are installed so as to be jointly pivotable around an axis 3 and, regarding their pivoting motion, are coupled with each other.

These holder inserts 4 normally shut in the case supported against the case bottom 2, can be swung up automatically by opening case cover 6 pivotally connected to the case bottom 2 at cover pivot 5.

A connecting clip 7 connects pivotally at one of its sides to the clip pivot 9 on the inner side of the case cover 6 and at its other opposite side to the pivot eye 8 on the first holder insert 4 adjacent the case cover 6.

This connecting clip 7 is formed from bent wire and comprises a clip arm 7.1 and two clip legs 7.2 extending from that, which have at the end of each a pivot eye 8 whose pivot eye axis is substantially parallel to clip arm 7.1.

The connecting clip 7 is inserted in clip pivot 9 with its clip arm pivotally on mounting bar 9.1 on the inner side of the case cover 6, and is pushed with each of the pivot eyes 8 onto each of the pivot pins 11 attached to the holder insert 4 closest to the case cover 6. The clip arm 7.1 extends on the same side from both clip legs 7.2, namely the wire out of which the clip 7 is constructed is bent back with the free end toward the left of the connecting clip 7.

Each of the clip legs 7.2 has an enlargement 12 lying in the plane of the clip legs 7.2 in positions approximately opposing each other. Both enlargements 12 are formed in the indicated plane as a pair of bent portions 13 in the shape of indentations 14 in the clip legs 7.2, so that on both clip legs 7.2 the indentations or crests 14 of the bent portions 13 lie on one side of the clip legs 7.2, and, of course, in the preferred embodiment on the side of the adjacent clip legs 7.2 face each other so that the indentations 14 are directed toward each other.

Therefore in this case only the indentations 14 are turned toward each other, since the clip legs 7.2 must have a sufficient spring to be pressed together for mounting the pivot eyes 8 on the extended pivot pins 11.

Figure 5:
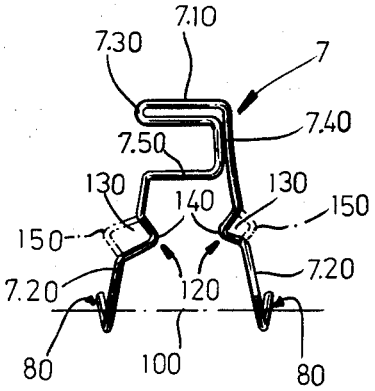
FIG. 5 is a front view of another embodiment of the connecting clip.
Figure 6:
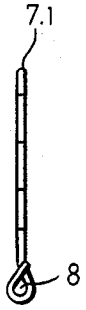
FIG. 6 is a side view of the connecting clip of the embodiment of FIG. 5.

The relationships and conditions are such that for this mounting an elastic expansion of the clip legs 7.2 or 7.22 may be required in which the indentations 14 or 140 of the bent portions 13 or 130 in both clip legs are turned away from each other, as is indicated with the dot-dash lines 15 in FIG. 5.

Furthermore for each bent portion 13 or 130 crests 14 or 140 can be provided on both sides of the clip legs so that a peripherally closed bent portion can arise in the shape of a loop, whose plane lies in the mounting plane of the connecting clip 7. In this case the connecting clip 7 can be mounted on the pivot pins 11 as one chooses by expansion or by having its clip legs 7.2 or 7.20 pressed together.

Figure 3:
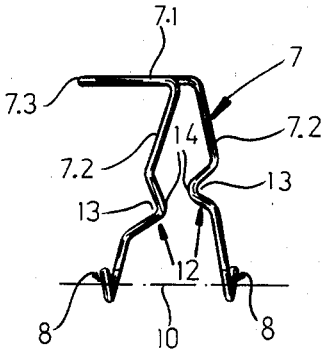
FIG. 3 is a front view of the connecting clip.
Figure 4:
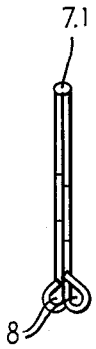
FIG. 4 is a side view of the connecting clip.

The clip legs 7.2 can, as seen in the FIGS. 3 and 4, be extended directly from clip arm 7.1 approximately V-shaped. In order that it can be compressed to a sufficient extent in this form, the structure which is seen in FIG. 3 is recommended, in which the bent portions 13 have crests which are turned toward each other in the clip legs, being slightly transposed in the lengthwise direction with respect to each other, so that they find a position abreast of each other in the pressed together clip legs 7.2 and the compressing of the clip legs 7.2 is not hindered by their contact with each other.

In the embodiment of FIG. 5 this is not the case, as here the clip legs 7.20 in the vicinity of the bends of the bent portions 13 have sufficiently large clearance from each other, so that there is no danger that the bent portions 130 will touch during the compression of the clip legs 7.20. In particular the specific embodiment of FIGS. 4 and 5 is characterized by the right leg 7.20 originating from the clip arm 7.10 being bent perpendicularly at its upper end toward the left clip leg 7.20 and a portion 7.40 of this clip leg 7.20 is bent so as to run parallel side-by-side with the left clip leg 7.20. Subsequently this parallel running piece is bent away from the left clip leg 7.20 to form right clip leg portion 7.50 running parallel to the clip arm 7.10. About in the middle of the clip legs 7.20 between this bent portion 7.50 and the pivot eye 80, the bent portions 130 form the enlargements 120 on both clip legs 7.20.

The clip arm 7.20 in combination with the bent portions 13 or 130 forming enlargements 12 or 120 on the clip legs 7.2 or 7.20 offer the possibility of fastening several of the connecting clips 7 in a systematic arrangement, preferably equally spaced from each other, the connecting clip always being provided to the initial mounting on the case. Moreover in the bent portions 13 or 130 forming the enlargements 12 or 120, a gripper of a gripper system here not further described can be engaged to hold the connecting clip 7 and can be input during the mounting so that the gripper can insert the connecting clip 7 with its clip arm 7.1 or 7.10 into the clip pivot 9 in the case cover 6.

Further the gripper holding the connecting clip 7 by the bent portions 13 or 130 can compress or expand the combining clip 7 by pressing together or pushing apart the clip legs 7.2 or 7.20 as required in order to make possible the loading of the pivot eye 8 on the pivot pins 11 of the holder insert 4.

I claim:

1. In a connecting clip having a clip arm and two clip legs extending from said clip arm, a pivot eye attached to the end of each of said clip legs opposite said arm with an axis of said pivot eye substantially parallel to said clip arm, a case for storage of objects, particularly slender work tools such as spiral drills, taps, or the like, said connecting clip attached to said case, said case comprising a case bottom having at least one pivotable holder insert therein for receiving said objects and a case cover connected to said holder insert by said connecting clip, by-means-of which said holder insert is swung up automatically when said case is opened by raising said cover, wherein said connecting clip is inserted in a clip pivot on the inner side of said case cover and is pushed so that said pivot eyes of said clip legs engage on and are held by said pivot pins of said holder insert, the improvement wherein said clip arm is substantially perpendicular to said clip legs and when said clip arm is inserted in said clip pivot said clip legs will both be on the same side of said clip pivot, and each of said clip legs has lying in the plane of said clip legs a bent portion having at least one bend, said bend having a crest, and said crests from each of said clip legs facing each other across both of said clip legs.

2. The improvement according to claim 1 wherein said crests on each of said clip legs are at least slightly shifted in the lengthwise direction with respect to one another, so that said bends are positioned abreast of one another in the pressed together clip legs and compression of said clip legs is not hindered.

3. The improvement according to claim 1 wherein said clip legs extending from said clip arm are formed substantially perpendicularly to said clip arm, and a portion of one of said substantially perpendicular clip legs is bent so as to run parallel side-by-side next to said second clip leg; and one of said clip legs is bent so as to have a portion running parallel to said clip arm, said portion of said clip leg bent parallel to said clip arm having a further portion bent back toward said other one of said clip legs; and approximately centrally located between said portion of said clip leg bent back toward said other one of said clip legs and said pivot eye, said bent portion having said bend and crest is positioned.

* * * * *